US005842835A

United States Patent [19]

Kawaguchi et al.

[11] Patent Number: 5,842,835

[45] Date of Patent: Dec. 1, 1998

[54] VARIABLE DISPLACEMENT COMPRESSOR AND ITS ASSEMBLING METHOD

[75] Inventors: Masahiro Kawaguchi; Masanori Sonobe; Ken Suitou; Takuya Okuno; Masakazu Murase; Koji Kawamura, all of Kariya, Japan

[73] Assignee: Kabushiki Kaisha Toyoda Jidoshokki Seisakusho, Kariya, Japan

[21] Appl. No.: 878,498

[22] Filed: Jun. 18, 1997

[30] Foreign Application Priority Data

Jun. 16, 1996 [JP] Japan ..... 8-158312
Jun. 16, 1996 [JP] Japan ..... 8-158313

[51] Int. Cl.[6] ..... F04B 1/29

[52] U.S. Cl. ..... 417/222.2; 417/270

[58] Field of Search ..... 417/222.1, 222.2, 417/270, 360

[56] References Cited

U.S. PATENT DOCUMENTS

| | | | |
|---|---|---|---|
| 5,529,461 | 6/1996 | Kawaguchi et al. | 417/222.2 |
| 5,603,610 | 2/1997 | Kawaguchi et al. | 417/222.2 |
| 5,636,973 | 6/1997 | Sonobe et al. | 417/222.2 |
| 5,785,502 | 7/1998 | Ota et al. | 417/222.2 |

*Primary Examiner*—Timothy Thorpe
*Assistant Examiner*—Cheryl J. Tyler
*Attorney, Agent, or Firm*—Brooks Haidt Haffner & Delahunty

[57] ABSTRACT

A compressor includes a cylinder block having a cylinder bore, a first housing attached to a first end of the cylinder block, a second housing attached to a second end of the cylinder block, a crank chamber defined between the cylinder block and the first housing, a drive plate located in the crank chamber and mounted on a drive shaft, and a piston operably coupled to the drive plate and located in the cylinder bore. The drive plate is tiltable between a maximum inclination position and a minimum inclination position according to a difference between the pressure in the crank chamber and the pressure in the cylinder bore. The cylinder block has a shutter chamber opening to the first end and the second end. A shutter member is accommodated in the shutter chamber. The shutter member is movable between a first position and a second position in response to the inclination of the drive plate to selectively connect and disconnect an external circuit with an suction chamber. The drive plate is held at the minimum inclination position when the shutter member is positioned in the second position. The shutter chamber has a diameter that is constant in an axial direction with respect to the shutter chamber. The shutter member is removably inserted into the shutter chamber from the second end of the cylinder block.

25 Claims, 7 Drawing Sheets

VARIABLE DISPLACEMENT COMPRESSOR AND ITS ASSEMBLING METHOD

BACKGROUND OF THE INVENTION

1. Field of the Invention

The present invention relates to a variable displacement compressor that changes its discharge displacement by changing the inclination of a swash plate. More particularly, the present invention relates to a variable displacement compressor that has a shutter for defining the minimum inclination of the swash plate and for stopping gas flow from an external circuit into the compressor and to a method for assembling the compressor.

2. Description of the Related Art

A typical variable displacement compressor includes a rotary shaft, a set of cylinder bores, and a piston fitted in each bore. A cam plate is supported by the rotary shaft in a crank chamber. The inclination of the cam plate is varied in accordance with the difference between the pressure in the crank chamber and the pressure in the cylinder bores. The stroke of each piston is varied in accordance with the inclination of the cam plate. The displacement of the compressor is varied, accordingly. The compressor is provided with a discharge chamber that is connected to the crank chamber by a supply passage. A displacement control valve is located in the supply passage for controlling the flow rate of refrigerant gas from the discharge chamber to the crank chamber thereby controlling the pressure in the crank chamber. The difference between the pressure in the crank chamber an the pressure in the cylinder bores is varied, accordingly.

The above described compressor is further provided with a shutter that stops gas flow from an external refrigerant circuit into the compressor when the compressor displacement is minimum. As shown in FIG. 7, a shutter chamber 112 is defined at the center portion of the cylinder block 111. A hollow cylindrical shutter 114 with a closed rear end is slidably accommodated in the shutter chamber 112. The chamber 112 includes a large diameter portion 112*a* for accommodating the shutter 114 and a small diameter portion 112*b* defined at the rear end portion of the chamber 112. A step 112*c* is defined by the large diameter portion 112*a* and the small diameter portion 112*b*. When assembling the compressor, the shutter 114 is inserted into the large diameter portion 112*a* from the front end (left end as viewed in FIG. 7) of the cylinder block 111.

A rear housing 120 is secured to the rear end face of the cylinder block 111 with a valve plate 121 in between. A suction passage 113 is defined in the rear housing 120 and is connected to an external refrigerant circuit (not shown). The passage 113 is also communicated with a suction chamber 122 defined in the rear housing 120 by the shutter chamber 112. A positioning surface 123 is formed on the valve plate 121 between the shutter chamber 112 and the suction passage 113 A spring 115 extends between the step 112*c* of the shutter chamber 112 and the shutter 114. The spring 115 urges the shutter 114 away from the positioning surface 123.

A radial bearing 116 is fixed to the inner wall of the shutter 114. The rear end of the rotary shaft 117 is supported by the bearing 116. The bearing 116 slides with respect to the shaft 117. A thrust bearing 119 is supported on the rotary shaft 117 and is located between the swash plate 118 and the shutter 114. The thrust bearing 119 slides along the axis of the rotary shaft 117.

The shutter 114 slides along the axis of the rotary shaft 117 in accordance with the tilting motion of the swash plate 118. Specifically, when the inclination of the swash plate 118 and the compressor displacement are maximum, the shutter 114 is located at an open position as illustrated by a continuous line in FIG. 7 for communicating the suction passage 113 with the suction chamber 122. The communication allows refrigerant gas in the external refrigerant circuit to enter the suction chamber 122 via the passage 113. The gas circulates between the compressor and the refrigerant circuit.

The swash plate 118 moves rearward as its inclination decreases. As it moves rearward, the swash plate 118 pushes the shutter 114 rearward through the thrust bearing 119. Accordingly, the shutter 114 moves toward the positioning surface 123 against the force of the spring 115. When the swash plate 118 reaches the minimum inclination and the compressor displacement is minimum, the rear end of the shutter 114 abuts against the positioning surface 123 as illustrated by a two-dot chain line in FIG. 7. The abutment locates the shutter 123 at the closed position for disconnecting the intake passage 113 and the suction chamber 122 and positions the swash plate 118 at a predetermined minimum inclination position.

The step 112*c* is defined by the large and small diameter portions 112*a*, 112*b*. Forming of the chamber 112 in the cylinder block 111 is troublesome and costly.

The size of each part of a compressor has an error within a predetermined tolerance. Also, when assembling the compressor, the position of each part with respect to the other parts has an error within a predetermined tolerance. The values of the errors are different in every compressor. The accumulation of the errors within predetermined tolerances in a compressor may result in an error that is significant. The swash plate 118 is at the minimum inclination position when the shutter abuts 114 against the positioning surface 123. However, this position deviates from the predetermined minimum inclination position by the accumulated errors. The amount of the deviation is different in every compressor. Thus, the minimum displacement is different in every compressor. If the minimum inclination position of the swash plate 118 deviates toward the maximum inclination position, the minimum displacement of the compressor is increased. In other words, the deviation increases the work of the compressor when the displacement is minimum. This increases the power loss of the external power source and reduces its fuel economy.

The rotary shaft 117 of a typical variable displacement compressor is directly connected to an external drive source such as an engine without an electromagnetic clutch in between. In this clutchless system, the compressor is operated at its minimum displacement even if refrigeration is not needed. Therefore, an increase in the minimum displacement of the compressor increases the power loss of the external drive source and reduces its fuel economy even when refrigeration is not needed.

Thus, the minimum inclination position of the swash plate 118 must be adjusted to match the predetermined minimum inclination position by replacing the shutter 114, the thrust bearing 119 or other parts. However, the shutter chamber 112 includes the small diameter portion 112*b* in the rear portion of the cylinder block 111. The shutter 114 can therefore be inserted and removed from the shutter chamber 112 only from the front end of the cylinder block 111. Thus, when replacing a part such as the shutter 114 or the thrust bearing 119, the front end of the compressor must be disassembled. This makes the replacement of parts extremely troublesome and time consuming.

SUMMARY OF THE INVENTION

Accordingly, it is an objective of the present invention to provide a variable displacement compressor in which the shutter chamber for accommodating the shutter is easily formed in a cylinder block. Another objective is to provide a method of assembly Another objective of the present invention is to provide a variable displacement compressor in which the minimum inclination position of the drive plate is readily adjusted.

To achieve the above objective, the compressor according to the present invention includes a cylinder block having a cylinder bore, a first housing attached to a first end of the cylinder block, a second housing attached to a second end of the cylinder block, a crank chamber defined between the cylinder block and the first housing, a drive plate located in the crank chamber and mounted on a drive shaft, and a piston operably coupled to the drive plate and located in the cylinder bore. The drive plate converts rotation of the drive shaft to reciprocating movement of the piston in the cylinder bore. The piston compresses gas supplied to the cylinder bore from a separate external circuit by way of a suction chamber and discharges the compressed gas to the external circuit by way of a discharge chamber. The drive plate is tiltable between a maximum inclination position and a minimum inclination position according to a difference between the pressure in the crank chamber and the pressure in the cylinder bore. The piston moves by a stroke based on the inclination of the drive plate to control the displacement of the compressor. The cylinder block has a shutter chamber extending along an axis of the drive shaft and opening to the first end and the second end. A shutter member is accommodated in the shutter chamber and is movable along the axis of the drive shaft. The shutter member is movable between a first position and a second position in response to the inclination of the drive plate. The shutter member connects the external circuit with the suction chamber in the first position and disconnects the external circuit from the suction chamber in the second position. The drive plate is held at the minimum inclination position when the shutter member is positioned in the second position. The shutter chamber has a diameter that allows said shutter member to be removably inserted into the shutter chamber from the second end of the cylinder block.

The present invention further discloses a method for assembling the above compressor. The compressor further includes a thrust bearing supported on the drive shaft between the drive plate and the shutter member, and a spring for biasing the shutter member toward the drive plate. The method comprises the steps of attaching the first housing, the drive shaft, the drive plate and the piston to the cylinder block from the first end, inserting the thrust bearing, the shutter member and the spring into the shutter chamber from the second end before the second housing is attached to the second end, and attaching a receiving member to the cylinder block from the second end to receive the spring.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A variable displacement compressor according to a first embodiment of the present invention will now be described with reference to FIGS. 1 to 3.

Figure 1:
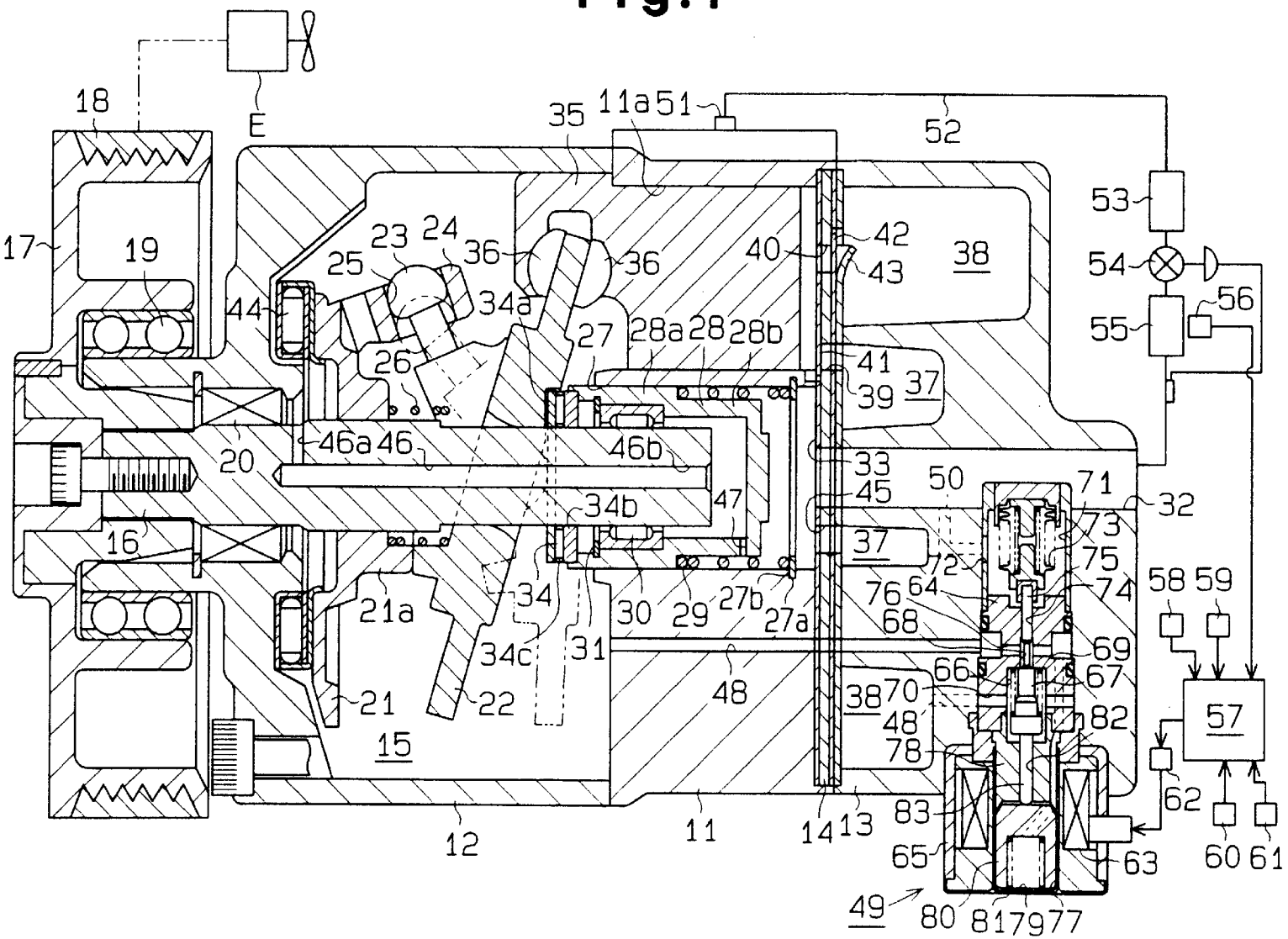
FIG. 1 is a cross-sectional view illustrating a variable displacement compressor according to a first embodiment of the present invention.

As shown in FIG. 1, a cylinder block 11 constitutes a part of the compressor housing. A front housing 12 is secured to the front end face of a cylinder block 11. A rear housing 13 is secured to the rear end face of the cylinder block 11 with a valve plate 14 in between. A crank chamber 15 is defined by the inner walls of the front housing 12 and the front end face of the cylinder block 11.

A rotary shaft 16 is rotatably supported in the front housing 12 and the cylinder block 11. The front end of the rotary shaft 16 protrudes from the crank chamber 15 and is secured to a pulley 17. The pulley 17 is directly coupled to an external drive source (a vehicle engine E in this embodiment) by a belt 18. The compressor of this embodiment is a clutchless type variable displacement compressor having no clutch between the rotary shaft 16 and the external drive source. The pulley 17 is supported by the front housing 12 with an angular bearing 19. The angular bearing 19 transfers thrust and radial loads that act on the pulley 17 to the housing 12.

A lip seal 20 is located between the rotary shaft 16 and the front housing 12 for sealing the crank chamber 15. The lip seal 20 prevents the pressure in the crank chamber 15 from leaking.

A substantially disk-like swash plate 22 is supported by the rotary shaft 16 in the crank chamber 15 to be slidable along and tiltable with respect to the axis of the shaft 16. The swash plate 22 is provided with a pair of guiding pins 23, each having a guide ball at the distal end and being fixed to the swash plate 22. A rotor 21 is fixed to the rotary shaft 16 in the crank chamber 15. The rotor 21 rotates integrally with the rotary shaft 16. The rotor 21 has a support arm 24 protruding toward the swash plate 22. A pair of guide holes 25 are formed in the support arm 24. Each guide pin 23 is slidably fitted into the corresponding guide hole 25. The cooperation of the arm 24 and the guide pins 23 causes the swash plate 22 to rotate together with the rotary shaft 16. The cooperation also guides the tilting of the swash plate 22 and the movement of the swash plate 22 along the axis of the rotary shaft 16. As the swash plate 22 slides rearward toward the cylinder block 11, the inclination of the swash plate 22 decreases.

A coil spring 26 is located between the rotor 21 and the swash plate 22. The spring 26 urges the swash plate 22 rearward, or in a direction decreasing the inclination of the swash plate 22. The rotor 21 is provided with a projection 21*a* on its rear end face. The abutment of the swash plate 22 against the projection 21*a* prevents the inclination of the swash plate 22 beyond the predetermined maximum inclination.

Figure 2:
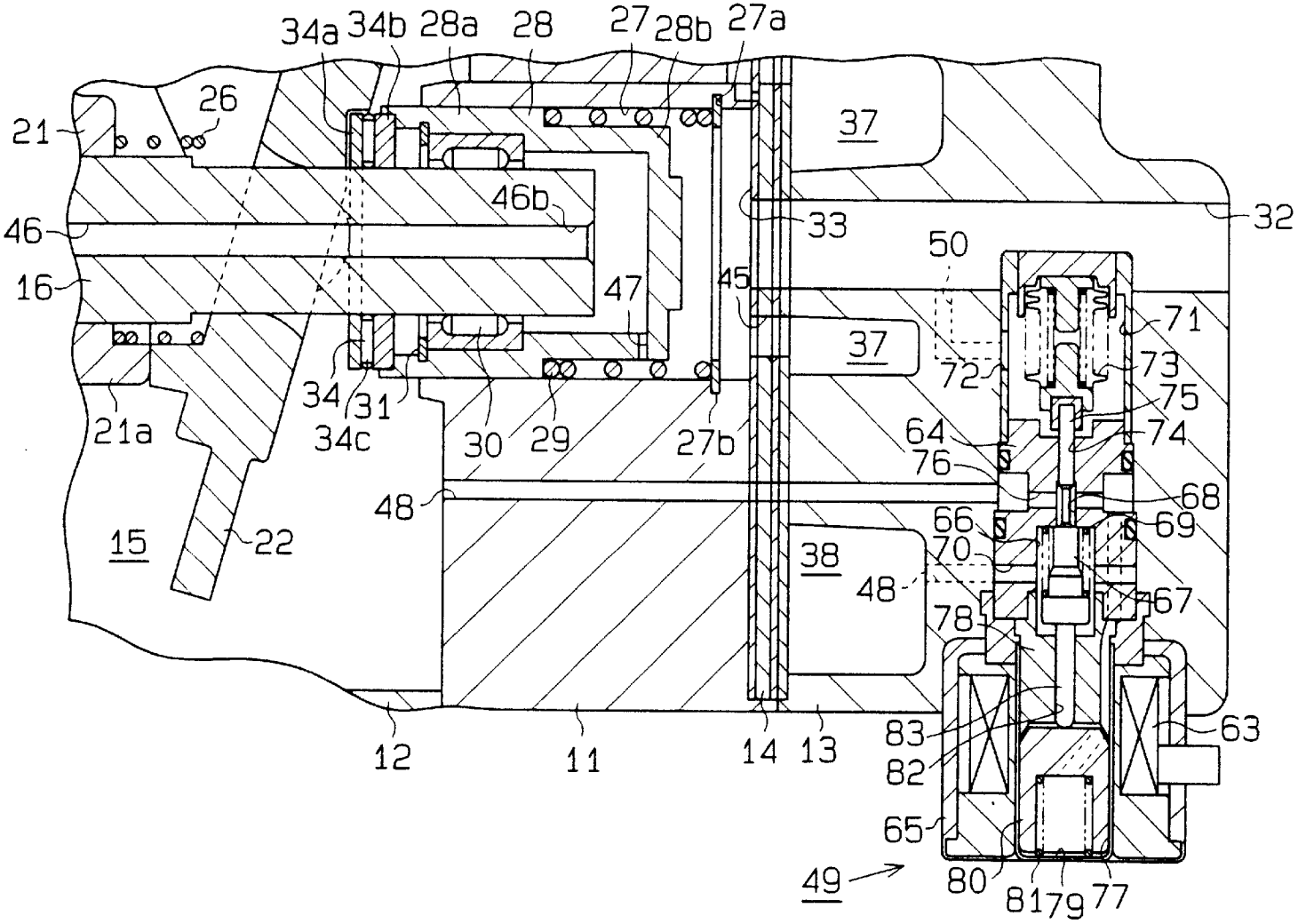
FIG. 2 is an enlarged partial cross-sectional view illustrating the compressor of FIG. 1 when the inclination of the swash plate is maximum.
Figure 3:
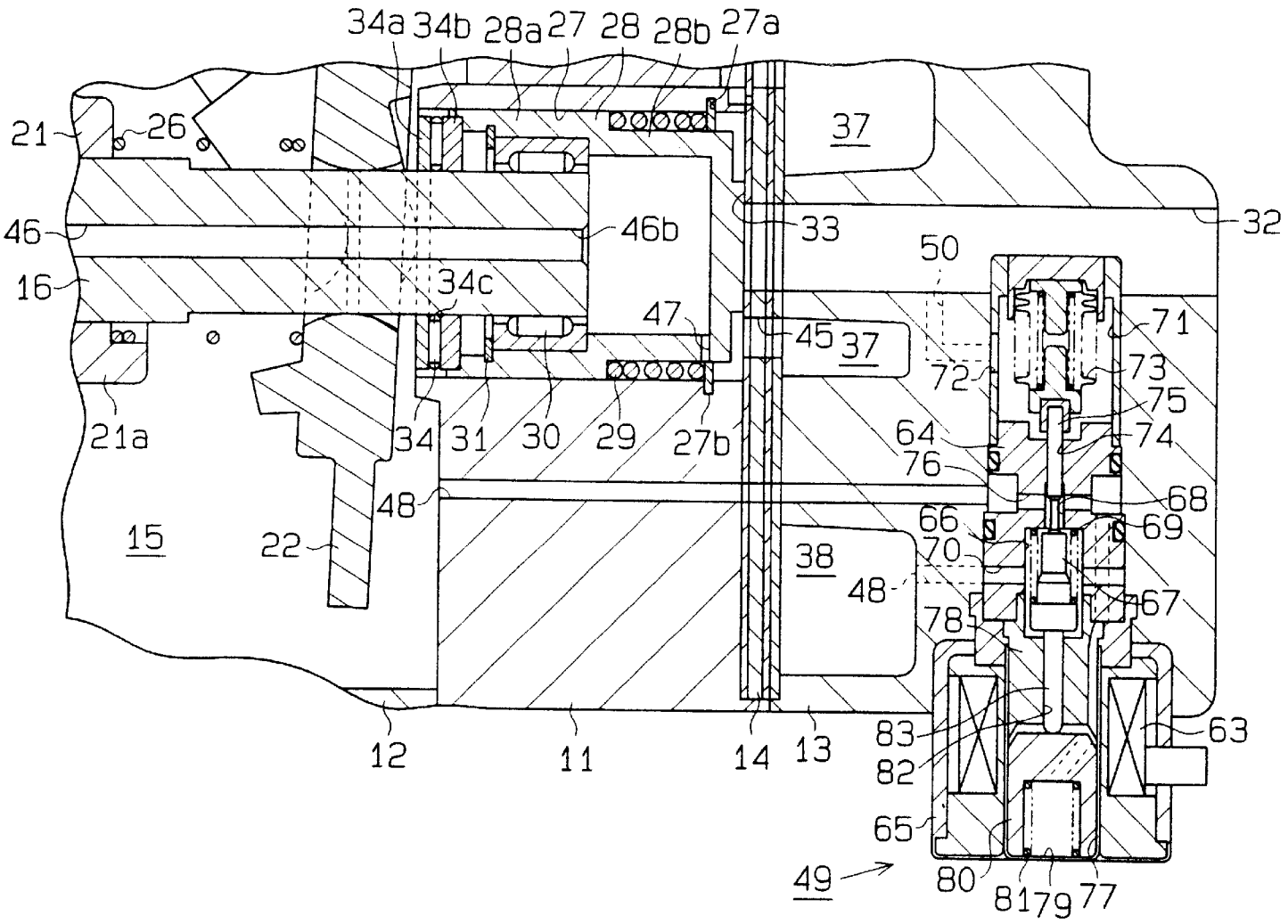
FIG. 3 is an enlarged partial cross-sectional view illustrating the compressor of FIG. 1 when the inclination of the swash plate is minimum.

As shown in FIGS. 1 to 3, a shutter chamber 27 is defined at the center portion of the cylinder block 11 extending along the axis of the rotary shaft 16. The diameter of the chamber 27 is constant in the axial direction. A hollow cylindrical shutter 28 having a closed end is accommodated in the shutter chamber 27. The shutter 28 slides along the axis of the rotary shaft 16. When installing the shutter 28 in the shutter chamber 27, the shutter 28 is inserted in the chamber 27 from the rear end of the cylinder block 11 (right side as viewed in FIGS. 1 to 3). The shutter 28 has a large diameter portion 28*a* and a small diameter portion 28*b*.

The rear end of the rotary shaft 16 is inserted in the shutter 28. A radial bearing 30 formed by a needle bearing is fixed to the inner wall of the large diameter portion 28*a* of the shutter 28 by a snap ring 31. Therefore, the radial bearing 30 slides with respect to the rotary shaft 16. The rear end of the rotary shaft 16 is supported by the inner wall of the shutter chamber 27 with the radial bearing 30 and the shutter 28 in between.

An annular groove 27*a* is formed in the rear part of the shutter chamber 27. A snap ring 27*b* is detachably fitted in the groove 27*a*. The snap ring 27*b* functions as a spring stop. A coil spring 29 is located between the snap ring 27*b* and a step, which is located between the large diameter portion 28*a* and the small diameter portion 28*b* of the shutter 28. The coil spring 29 urges the shutter 28 toward the swash plate 22. The urging force of the spring 29 is smaller than that of the spring 26.

A suction passage 32 is defined at the center portion of the rear housing 13 and the valve plate 14. The passage 32 is aligned with the axis of the rotary shaft 16 and is communicated with the shutter chamber 27. The suction passage 32 functions as a suction pressure area. A positioning surface 33 is formed on the valve plate 14 about the inner opening of the suction passage 32. The rear end of the shutter 28 abuts against the positioning surface 33. Abutment of the shutter 28 against the positioning surface 33 prevents the shutter 28 from further moving rearward away from the rotor 21. The abutment also disconnects the suction passage 32 from the shutter chamber 27.

A thrust bearing 34 is supported on the rotary shaft 16 and is located between the swash plate 22 and the shutter 28. The thrust bearing 34 slides along the axis of the rotary shaft 16. The bearing 34 is constantly retained between the swash plate 22 and the shutter 28 by the force of the coil spring 29 and prevents the rotation of the swash plate 22 from being transmitted to the shutter 28.

The swash plate 22 moves rearward as its inclination decreases. As it moves rearward, the swash plate 22 pushes the shutter 28 rearward through the thrust bearing 34. Accordingly, the shutter 28 moves toward the positioning surface 33 against the force of the coil spring 29. When the swash plate 22 reaches the minimum inclination as shown in FIG. 3, the rear end of the shutter 28 abuts against the positioning surface 33. In this state, the shutter 28 is located at the closed position for disconnecting the shutter chamber 27 from the suction passage 32.

A plurality of cylinder bores 11*a* extend through the cylinder block 11 and are located about the axis of the rotary shaft 16. The cylinder bores 11*a* are spaced apart at equal intervals. A single-headed piston 35 is accommodated in each cylinder bore 11*a*. A pair of semispherical shoes 36 are fitted between each piston 35 and the swash plate 22. A semispherical portion and a flat portion are defined on each shoe 36. The semispherical portion slidably contacts the piston 35 while the flat portion slidably contacts the swash plate 22. The swash plate 22 is rotated by the rotary shaft 16 through the rotor 21. The rotating movement of the swash plate 22 is transmitted to each piston 35 through the shoes 36 and is converted to linear reciprocating movement of each piston 35 in the associated cylinder bore 11*a*.

A suction chamber 37 is defined in the center portion of the rear housing 13. The suction chamber 37 is communicated with the shutter chamber 27 via a communication hole 45. A discharge chamber 38 is defined about the suction chamber 37 in the rear housing 13. Suction ports 39 and discharge ports 40 are formed in the valve plate 14. Each suction port 39 and each discharge port 40 correspond to one of the cylinder bores 11*a*. Suction valve flaps 41 are formed on the valve plate 14. Each suction valve flap 41 corresponds to one of the suction ports 39. Discharge valve flaps 42 are formed on the valve plate 14. Each discharge valve flap 42 corresponds to one of the discharge ports 40.

As each piston 35 moves from the top dead center to the bottom dead center in the associated cylinder bore 11*a*, refrigerant gas in the suction chamber 37 is drawn into each cylinder bore 11*a* through the associated suction port 39 while causing the associated suction valve flap 41 to flex to an open position. As each piston 35 moves from the bottom dead center to the top dead center in the associated cylinder bore 11*a*, refrigerant gas is compressed in the cylinder bore 11*a* and discharged to the discharge chamber 38 through the associated discharge port 40 while causing the associated discharge valve flap 42 to flex to an open position. Retainers 43 are formed on the valve plate 14. Each retainer 43 corresponds to one of the discharge valve flaps 42. The opening amount of each discharge valve flap 42 is defined by contact between the valve flap 42 and the associated retainer 43.

A thrust bearing 44 is located between the front housing 12 and the rotor 21. The thrust bearing 44 carries the reactive force of gas compression acting on the rotor 21 through the pistons 35 and the swash plate 22.

A pressure release passage 46 is defined at the center portion of the rotary shaft 16. The pressure release passage 46 has an inlet 46*a*, which opens to the crank chamber 15 in the vicinity of the lip seal 20, and an outlet 46*b*, which opens to the interior of the shutter 28. A pressure release hole 47 is formed in the peripheral wall near the rear end of the shutter 28. The hole 47 communicates the interior of the shutter 28 with the shutter chamber 27.

A supply passage 48 is defined in the rear housing 13, the valve plate 14 and the cylinder block 11 for communicating the discharge chamber 38 with the crank chamber 15. A displacement control valve 49 is accommodated in the rear housing 13 midway in the supply passage 48. A pressure introduction passage 50 is defined in the rear housing 13 for communicating the control valve 49 with the suction passage 32. Thus, suction pressure Ps is communicated with the control valve 49.

An outlet port 51 is formed in the cylinder block 11 and is communicated with the discharge chamber 38. The outlet port 51 is connected to the suction passage 32 by an external refrigerant circuit 52. The refrigerant circuit 52 includes a condenser 53, an expansion valve 54 and an evaporator 55.

The expansion valve 54 controls the flow rate of refrigerant in accordance with the temperature of refrigerant gas at the outlet of the evaporator 55. A temperature sensor 56 is located in the vicinity of the evaporator 55. The temperature sensor 56 detects the temperature of the evaporator 55 and issues signals relating to the detected temperature to a control computer 57. The computer 57 is connected to various devices including a temperature adjuster 58, a compartment temperature sensor 59, an air conditioner starting switch 60 and an engine speed sensor 61. A passenger sets a desirable compartment temperature, or a target temperature, by the temperature adjuster 58.

The computer 57 computes a current value for the control valve 49 based on various conditions including, for example, a target temperature set by the temperature adjuster 58, the temperature detected by the temperature sensor 56, the passenger compartment temperature detected by the temperature sensor 59, an ON/OFF signal from the starting switch 60 and the engine speed detected by the engine speed sensor 61 . The computer 57 transmits the computed current value to a driver 62. The driver 62 sends a current having the value transmitted from the computer 57 to a coil 63 of a solenoid 65 in the valve 49. The coil 63 and the solenoid 65 will be described later. The conditions for determining the current value for the valve 49 may include data other than those listed above, for example, the data may include the temperature outside of the vehicle.

As shown in FIGS. 1 to 3, the control valve 49 includes a housing 64 and the solenoid 65, which are secured to each other. A valve chamber 66 is defined between the housing 64 and the solenoid 65. The valve chamber 66 is connected to the discharge chamber 38 by the supply passage 48. A valve body 67 is arranged in the valve chamber 66. The area about the opening of the valve hole 68 functions as a valve seat, against which a top end of the valve body 67 abuts. A first coil spring 69 extends between the valve body 67 and a wall of the valve chamber 66 for urging the valve body 67 in a direction opening the valve hole 68.

A pressure sensing chamber 71 is defined at the upper portion of the housing 64. The pressure sensing chamber 71 is provided with a bellows 73 and is connected to the suction passage 32 by a second port 72 and the pressure introduction passage 50. A first guide hole 74 is defined in the housing 64 between the pressure sensing chamber 71 and the valve hole 68. The axis of the first guide hole 74 is aligned with the axis of the valve hole 68. The bellows 73 is connected to the valve body 67 by a first rod 75. The first rod 75 slides with respect to the hole 74 and has a small diameter portion, which extends through the valve hole 68. A clearance between the small diameter portion of the rod 75 and the valve hole 68 permits the flow of refrigerant gas.

A third port 76 is defined in the housing 64 between the valve chamber 66 and the pressure sensing chamber 71. The third port 76 intersects the valve hole 68. The valve hole 68 is connected to the crank chamber 15 by the third port 76 and the supply passage 48. Thus, the first port 70, the valve chamber 66, the valve hole 68 and the third port 76 constitute a part of the supply passage 48.

An accommodating hole 77 having an open upper end is defined in the center portion of the solenoid 65. A fixed steel core 78 is fitted in the upper portion of the hole 77. A plunger chamber 79 is defined by the fixed core 78 and inner walls of the hole 77 at the lower portion of the hole 77 in the solenoid 65. A cylindrical plunger 80 having a closed end is accommodated in the plunger chamber 79 and slides along the axis of the chamber 79. A second coil spring 81 extends between the plunger 80 and the bottom of the hole 77. The urging force of the second coil spring 81 is smaller than that of the first coil spring 69.

A second guide hole 82 is defined in the fixed core 78 between the plunger chamber 79 and the valve chamber 66. A second rod 83 is formed integrally with the valve body 67 and projects downward from the bottom of the valve body 67. The second rod 83 is accommodated in and slides with respect to the second guide hole 82. The first spring 69 urges the valve body 67 downward, while the second spring 81 urges the plunger 80 upward. This allows the lower end of the second rod 83 to constantly contact the plunger 80. In other words, the valve body 67 moves integrally with the plunger 80 with the second rod 83 in between.

A cylindrical coil 63 is wound about the core 78 and the plunger 80. The driver 62 supplies the coil 63 with a current having a value computed by the computer 57.

The thrust bearing 34 located between the swash plate 22 and the shutter 28 is a rolling bearing such as a needle bearing. The bearing 34 includes a front race member 34*a*, a rear race member 34*b* and a plurality of needles 34*c* located between the race members 34*a*, 34*b*. The rear race member 34*b* functions as an adjuster for adjusting the minimum inclination position of the swash plate 22. That is, the rear race member 34b is made available in different thicknesses.

The diameter of the shutter chamber 27 for accommodating the shutter 28 is constant in the axial direction. The thrust bearing 34, the shutter 28 and the spring 29 are inserted in the shutter chamber 27 from the rear end of the cylinder block 11 before attaching the valve plate 14 and the rear housing 13 to the cylinder block 11. The bearing 34, the shutter 28 and the spring 29 are held in place by fitting the snap ring 27*b* in the groove 27*a*.

The operation of the above described compressor will hereafter be described.

If the switch 60 is turned on and the compartment temperature detected by the sensor 59 is higher than a target temperature set by the temperature adjuster 58, the computer 57 commands the driver 62 to excite the solenoid 65. The driver 62 then supplies the coil 63 with a current having a value computed by the computer 57 thereby producing a magnetic attractive force in accordance with the current between the core 78 and the plunger 80. The attractive force is transmitted to the valve body 67 by the second rod 83 and thus urges the valve body 67 against the force of the first spring 69 in a direction closing the valve hole 68. On the other hand, the length of the bellows 73 changes in accordance with the suction pressure Ps in the suction passage 32 that is introduced to the pressure sensing chamber 71 via the passage 50. The changes in the length of the bellows 73 is transmitted to the valve body 67 by the first rod 75. The higher the suction pressure Ps is, the shorter the bellows 73 becomes. As the bellows 73 becomes shorter, the bellows 73 pulls the valve body 67 in a direction closing the valve hole 68.

The opening area between the valve body 67 and the valve hole 68 is determined by the equilibrium of a plurality of forces acting on the valve body 67. Specifically, the opening area is determined by the equilibrium position of the body 67, which is affected by the force of the solenoid 65, the force of the bellows 73,the force of the first spring 69, and the second spring 81.

Suppose the cooling load is great, and the temperature in the vehicle compartment detected by the sensor 59 is significantly higher than a target temperature set by the temperature adjuster 58. The computer 57 commands the driver 62 to increase the value of the current supplied to the coil 63 of the valve 49 when the difference between the detected temperature and the target temperature is great. This increases the magnitude of the attractive force between the core 78 and the plunger 80 thereby increasing the resultant force urging the valve body 67 in a direction closing the valve hole 68. This lowers the value of pressure Ps required for opening of the valve hole 68. Increasing the value of the current to the valve 49 causes the valve 49 to maintain a lower suction pressure Ps.

A smaller opening area between the valve body 67 and the valve hole 68 decreases the amount of refrigerant gas flow from the discharge chamber 38 to the crank chamber 15 via the supply passage 48. The refrigerant gas in the crank chamber 15 flows into the suction chamber 37 via the pressure release passage 46 and the pressure release hole 47. This lowers the pressure Pc in the crank chamber 15. Further, when the cooling load is great, the suction pressure Ps is high. Accordingly, the pressure in each cylinder bore 11*a* is high. Therefore, the difference between the pressure Pc in the crank chamber 15 and the pressure in each cylinder 11*a* is small. This increases the inclination of the swash plate 22 thereby allowing the compressor to operate at a large displacement.

When the valve hole 68 in the valve 49 is completely closed by the valve body 67, the supply passage 48 is closed. Accordingly, the supply of the highly pressurized refrigerant gas in the discharge chamber 38 to the crank chamber 15 is stopped. Therefore, the pressure Pc in the crank chamber 15 becomes substantially the same as the low pressure Ps in the suction chamber 37. The inclination of the swash plate 22 thus becomes maximum as shown in FIGS. 1 and 2, and the compressor operates at the maximum displacement. The swash plate 22 is prevented from inclining beyond the predetermined maximum inclination by the abutment of the swash plate 22 and the projection 21*a* of the rotor 21.

Suppose the cooling load is small, the difference between the compartment temperature detected by the sensor 59 and the target temperature set by the temperature adjuster 58 is small. The computer 57 commands the driver 62 to decrease the current value to the coil 63 of the valve 49 for a smaller difference between the detected temperature and the target temperature. This decreases the magnitude of the attractive force between the core 78 and the plunger 80 thereby decreasing the resultant force urging the valve body 67 in a direction closing the valve hole 68. This increases the value of the pressure Ps that will open the valve hole 68. Decreasing the value of the current to the valve 49 causes the valve 49 to maintain a higher suction pressure Ps.

A larger opening area between the valve body 67 and the valve hole 68 increases the refrigerant gas flow from the discharge chamber 38 to the crank chamber 15. The pressure Pc in the crank chamber 15 is increased, accordingly. Further, when the cooling load is small, the suction pressure Ps is low and the pressure in each cylinder bore 11*a* is low. Therefore, the difference between the pressure Pc in the crank chamber 15 and the pressure in each cylinder 11*a* is great. This decreases the inclination of the swash plate 22 as shown in FIG. 3 thereby allowing the compressor to operate at a small displacement.

As cooling load approaches zero, the temperature of the evaporator 55 in the refrigerant circuit 52 drops to a frost forming temperature. When the temperature sensor 56 detects a temperature that is lower than the frost forming temperature, the computer 57 commands the driver 62 to de-excite the solenoid 65. The driver 62 stops sending current to the coil 63, accordingly. This eliminates the magnetic attractive force between the core 78 and the plunger 80. The valve body 67 is then moved in a direction opening the valve hole 68 by the force of the first spring 69 against the force of the spring 81 transmitted by the plunger 80 and the second rod 83 as shown in FIG. 3. This maximizes the opening area between the valve body 67 and the valve hole 68. Thus, the gas flow from the discharge chamber 38 to the crank chamber 15 is increased. This further raises the pressure Pc in the crank chamber 15 thereby minimizing the inclination of the swash plate 22. The compressor thus operates at the minimum displacement.

When the switch 60 is turned off, the computer 57 commands the driver 62 to de-excite the solenoid 65. This also minimizes the inclination of the swash plate 22.

As described above, when the value of the current to the coil 63 is increased, the valve body 67 of the valve 49 allows the opening area of the valve hole 68 to be controlled by a lower suction pressure Ps. When the value of the current to the coil 63 is decreased, on the other hand, the valve body 67 allows the opening area of the valve hole 68 to be controlled by a higher suction pressure Ps. The compressor controls the inclination of the swash plate 22 to adjust its displacement thereby maintaining a target suction pressure Ps. That is, the valve 49 changes the suction pressure Ps to a target suction pressure in accordance with the value of the current supplied thereto. A compressor equipped with the control valve 49 varies the cooling ability of the air conditioner.

The shutter 28 slides in accordance with the tilting motion of the swash plate 22. As the inclination of the swash plate 22 decreases, the shutter 28 gradually reduces the cross-sectional area of the passage between the suction passage 32 and the suction chamber 37. This gradually reduces the amount of refrigerant gas that enters the suction chamber 37 from the suction passage 32. The amount of refrigerant gas that is drawn into the cylinder bores 11*a* from the suction chamber 37 gradually decreases, accordingly. As a result, the displacement of the compressor gradually decreases. This gradually lowers the discharge pressure Pd of the compressor. The load torque of the compressor thus gradually decreases. In this manner, the load torque for operating the compressor does not change dramatically in a short time when the displacement decreases from the maximum to the minimum. The shock that accompanies load torque fluctuations is therefore lessened.

When the inclination of the swash plate 22 is minimum as illustrated in FIG. 3, the shutter 28 abuts against the positioning surface 33. The abutment prevents the inclination of the swash plate 22 from being smaller than the predetermined minimum inclination. The abutment also disconnects the suction passage 32 from the suction chamber 37. This stops the gas flow from the refrigerant circuit 52 to the suction chamber 37 thereby stopping the circulation of refrigerant gas between the circuit 52 and the compressor.

The rear race 34*b* of the thrust bearing 34 is selected such that the minimum inclination of the swash plate 22 is slightly larger than zero degrees. Zero degrees refers to the angle of the swash plate's inclination when it is perpendicular to the axis of the rotary shaft 16. Therefore, even if the inclination of the swash plate 22 is minimum, refrigerant gas in the cylinder bores 11*a* is discharged to the discharge chamber 38 and the compressor operates at the minimum displacement. The refrigerant gas discharged to the discharge chamber 38 from the cylinder bores 11*a* is drawn into the crank chamber 15 through the supply passage 48. The refrigerant gas in the crank chamber 15 is drawn back into the cylinder bores 11*a* through the pressure release passage 46, a pressure release hole 47 and the suction chamber 37. That is, when the inclination of the swash plate 22 is minimum, refrigerant gas circulates within the compressor traveling through the discharge chamber 38, the supply passage 48, the crank chamber 15, the pressure release passage 46, the pressure release hole 47, the suction chamber 37 and the cylinder bores 11*a*. This circulation of refrigerant gas allows the lubricant oil contained in the gas to lubricate the moving parts of the compressor.

When the switch 60 is turned on and the inclination of the swash plate 22 is minimum, if the cooling load is increased by an increase in the compartment temperature increase, the compartment temperature detected by the sensor 59 becomes higher than a target temperature set by the temperature adjuster 58. The computer 57 commands the driver 62 to excite the solenoid 65 in accordance with the detected temperature increase. When the solenoid 65 is excited, the supply passage 48 is closed. This stops the flow of refrigerant gas from the discharge chamber 38 into the crank chamber 15. The refrigerant gas in the crank chamber 15 flows into the suction chamber 37 via the pressure release passage 46 and the pressure release hole 47. This gradually lowers the pressure Pc in the crank chamber 15 thereby moving the swash plate 22 from the minimum inclination to the maximum inclination.

As the swash plate's inclination increases, the force of the spring 29 gradually pushes the shutter 28 away from the positioning surface 33. This gradually increases the cross-sectional area of the passage between the suction passage 32 to the suction chamber 37 thereby gradually increasing the amount of refrigerant gas flow from the suction passage 32 into the suction chamber 37. Therefore, the amount of refrigerant gas drawn into the cylinder bores 11*a* from the suction chamber 37 gradually increases. This allows the displacement of the compressor to gradually increase. Thus, the discharge pressure Pd of the compressor gradually increases and the torque needed for operating the compressor also gradually increases accordingly. In this manner, the load torque of the compressor does not change dramatically in a short time when the displacement increases from the minimum to the maximum. The shock that accompanies load torque fluctuations is therefore lessened.

If the engine E is stopped, the compressor is also stopped (that is, the rotation of the swash plate 22 is stopped). Also, the supply of current to the coil 63 in the valve 49 is stopped. This de-excites the solenoid 65 thereby opening the supply passage 48. The inclination of the swash plate 22 is thus minimum.

When assembling the compressor, the minimum inclination position of the swash plate 22 is adjusted by using a measuring race member having a predetermined thickness. That is, the compressor is temporarily assembled with the measuring race member instead of the rear race member 34*b*. At this point, the valve plate 14 and the rear housing 13 have not been attached to the cylinder block. Thus, the rear end of the cylinder block 11 is open. In this state, the stroke of the pistons 35 when the swash plate 22 is at the minimum inclination position (in other words, when the shutter 28 is abutting against the positioning surface 33) is measured.

When measuring the stroke of the pistons 35, the valve plate 14, on which the positioning surface 33 is defined, is not attached to the cylinder block 11. Therefore, a plate that at least blocks the opening of the shutter chamber 27 is provided to contact the rear end of the cylinder block 11. This plate functions as the positioning surface 33 when the stroke of the pistons 35 is measured.

The stroke of the pistons 35 corresponds to the inclination of the swash plate 22. Therefore, a rear race member 34*b* is selected based on the measured stroke, such that the pistons 35 reciprocate at a predetermined stroke when the shutter 28 is abutting against the positioning surface 33 (in other words, such that the swash plate 22 is located at a predetermined minimum inclination position). The measuring race member is replaced with a selected rear race member 34*b*. In this manner, the minimum inclination position of the swash plate 22 is adjusted by selecting a rear race member 34*b* having an appropriate thickness.

When replacing the measuring race member with the selected rear race member 34*b*, the rear end of the cylinder block 11 is opened by removing the valve plate 14 and the rear housing 13 therefrom. Then, the snap ring 27*b* is detached from the groove 27*a* in the shutter chamber 27 and is taken out from the open end, or the rear end of the cylinder block 11. The spring 29, the shutter 28, and the thrust bearing 34 are taken out from the shutter chamber 27 through the rear end of the cylinder block 11. Thereafter, the measuring race member used in the thrust bearing 34 is replaced with the selected rear race member 34*b*. The thrust bearing 34 having the selected race member 34b, the shutter 28 and the spring 29 are inserted in the shutter chamber 27 through the rear end of the cylinder block 11. Finally, the snap ring 27*b* is fitted in the groove 27*a* to complete the replacement of the measuring race member with the rear race member 34*b*. Then, the valve plate 14 and the rear housing 13 are attached to the rear end of the cylinder block 11.

Since the diameter of the shutter chamber 27 is constant in the axial direction, the thrust bearing 34, the shutter 28 and the spring 29 can be inserted into and taken out from the rear end of the cylinder block 11. This eliminates the necessity for inserting or taking out the parts 34, 28, 29 through the front end of the cylinder block 11.

When measuring the stroke of the pistons 35, parts such as the front housing 12, the drive shaft 16, the swash plate 22 and the pistons 35 must be attached to the front end of the cylinder block 11. Therefore, if the shutter related parts 34, 28, 29 can be installed to and removed from the shutter chamber 27 only through the front end of the cylinder block 11, the following procedures are required. The stroke of the pistons 35 must be measured after the parts such as front housing 12 are attached to the front end of the cylinder bore 11. Then, parts such as the front housing 12 are temporarily detached from the cylinder block 11. In this state, the shutter related parts 34, 28, 29 are removed from the shutter chamber 27 for replacing the measuring race member with the selected rear race member 34*b*. Thereafter, the shutter related parts 34, 28, 29 are put back into the chamber 27. Finally, parts such as the front housing 12 are attached to the front end of the cylinder block 11 again. Accordingly, the adjustment of the minimum inclination position of the swash plate 22 is extremely troublesome and time consuming.

In the preferred and illustrated embodiment, the adjustment of the minimum inclination position of the swash plate 22 is performed before the valve plate 14 and the rear housing 13 are attached to the rear end of the cylinder block 11. The shutter related parts 34, 28, 29 are removed from and inserted into the shutter chamber 27 from the rear end of the cylinder block 11. Therefore, when adjusting the minimum inclination position of the swash plate 22, it is not necessary to remove the valve plate 14 and the rear housing 13 from the rear end of the cylinder block 11. That is, the valve plate 14 and the rear housing 13 are not attached to the rear end of the cylinder block 11 until after the piston stroke has been measured using the measuring race member and after the shutter related parts 34, 38, 29 including the selected rear race member 34*b* have been put back into the chamber 27. Accordingly, the adjustment of the minimum inclination position of the swash plate 22 is facilitated and can be performed in a short period of time.

As described above, the diameter of the shutter chamber 27 for accommodating the shutter 28 is constant in the axial direction. This facilitates the forming of the chamber 27 in the cylinder block 11 thereby reducing the cost of manufacture.

The snap ring 27*b*, which functions as a spring stop, is detachably fitted in the groove 27*a*. The rear end of the coil spring 29, which urges the shutter 28 toward the swash plate 22, is supported by the snap ring 27*b*. The snap ring 27*b* is fitted in the groove 27*b* after the shutter 28 and the spring 29 are inserted in the shutter chamber 27 through the rear end of the cylinder block 11. Thus, the shutter 28 and the spring 29 are securely retained in the shutter chamber 27. Therefore, the spring 29 does not pop out from the shutter chamber 27 when the rear end of the cylinder block 11 is opened for adjusting the minimum inclination position of the swash plate 22. The adjustment of the minimum inclination position of the swash plate 22 is thus further facilitated.

The rear race member 34*b* of the thrust bearing 34, which is located between the swash plate 22 and the shutter 28, functions as an adjuster for adjusting the minimum inclination position of the swash plate 22. The rear race member 34*b* is made available in different thicknesses. Among the available selection of the members 34*b*, one member 34*b* that has an appropriate thickness is selected. The thickness of the selected member 34*b* will allow the minimum inclination of the swash plate 22 to match a predetermined minimum inclination position. The compressor is assembled with the selected rear race member 34*b*. Therefore, the minimum inclination position of the swash plate 22 when the shutter 28 abuts against the positioning surface 33 matches the predetermined position. This equalizes the minimum displacements of different compressors. Further, the minimum displacement of the individual compressors is prevented from being greater than the predetermined minimum displacement. Accordingly, power loss of the engine E is prevented and the fuel economy of the engine E is improved. Especially in clutchless system, in which the rotary shaft 16 is directly connected to the engine E, the power loss is more effectively reduced and the fuel economy is further improved.

The minimum inclination position of the swash plate 22 is adjusted simply by selecting a rear race member 34*b* having an appropriate thickness and by assembling the compressor with the selected member 34*b*. Therefore no extra parts in the compressor are needed for adjusting the minimum inclination of the plate 22. The number of parts in the compressor is thus minimized and the structure of the compressor is simplified.

When the compressor is operating, a great thrust load acts on the thrust bearing 34 through the pistons 35 and the swash plate 22. The thrust bearing 34 is a needle bearing and therefore has a high durability. Thus, the bearing 34 can withstand the great thrust load.

A variable displacement compressor according to a second embodiment will hereafter be described with reference to FIG. 4. The differences from the first embodiment will mainly be discussed below, and like or the same reference numerals are given to those components that are like or the same as the corresponding components of the first embodiment.

Figure 4:
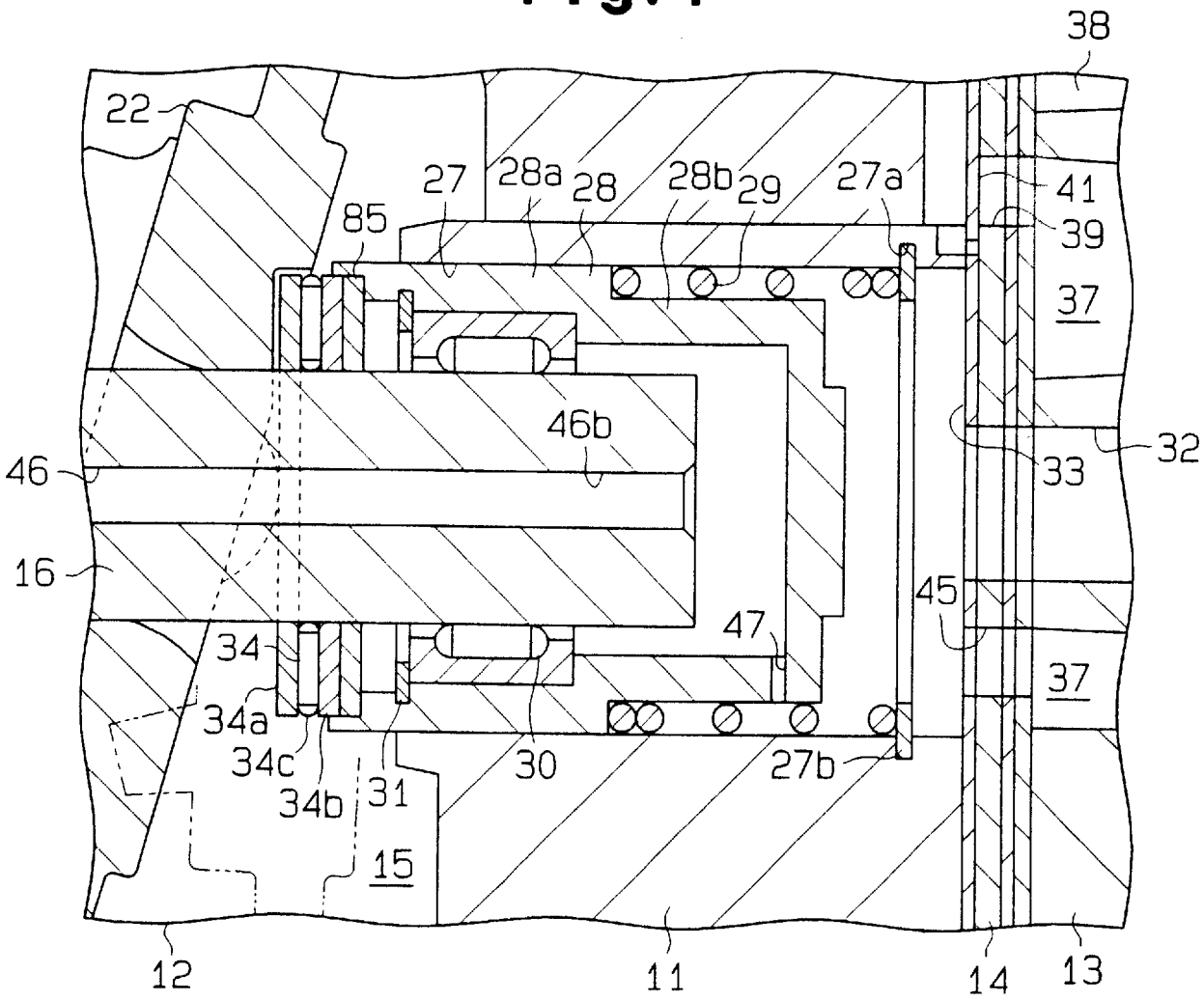
FIG. 4 is an enlarged partial cross-sectional view illustrating a variable displacement compressor according to a second embodiment of the present invention.

As shown in FIG. 4, a ring-shaped spacer 85 is located between the rear race member 34*b* of the thrust bearing 34 and the shutter 28. The spacer 85 functions as an adjuster for adjusting the minimum inclination position of the swash plate 22. The spacer 85 is made available in different thicknesses. Unlike the first embodiment, the thrust bearing 34 has a rear race member 34b having a fixed thickness.

When assembling the compressor, the minimum inclination position of the swash plate 22 is adjusted by using a measuring spacer having a predetermined thickness. That is, the compressor is temporarily assembled with the measuring spacer instead of the spacer 85. Then, as in the first embodiment, the stroke of the pistons 35 is measured. Based on the measured stroke, a spacer 85 that is optimum for the compressor is selected. The measuring spacer is replaced with the selected spacer 85. In this manner, the minimum inclination position of the swash plate 22 is adjusted by the spacer 85.

As in the first embodiment, the replacement of the measuring spacer with the selected spacer 85 is performed from the rear end of the cylinder block 11. Therefore, this embodiment has the same advantages as the first embodiment. Further, unlike the first embodiment, the measuring rear race member is not used. Instead, the measuring spacer is replaced with a selected spacer 85. Thus, disassembly of the thrust bearing 34 is not necessary. This facilitates the adjustment of the minimum inclination position of the swash plate 22.

A variable displacement compressor according to a third embodiment will hereafter be described with reference to FIGS. 5 and 6. The differences from the first embodiment will mainly be discussed below, and like or the same reference numerals are given to those components that are like or the same as the corresponding components of the first embodiment.

Figure 5:
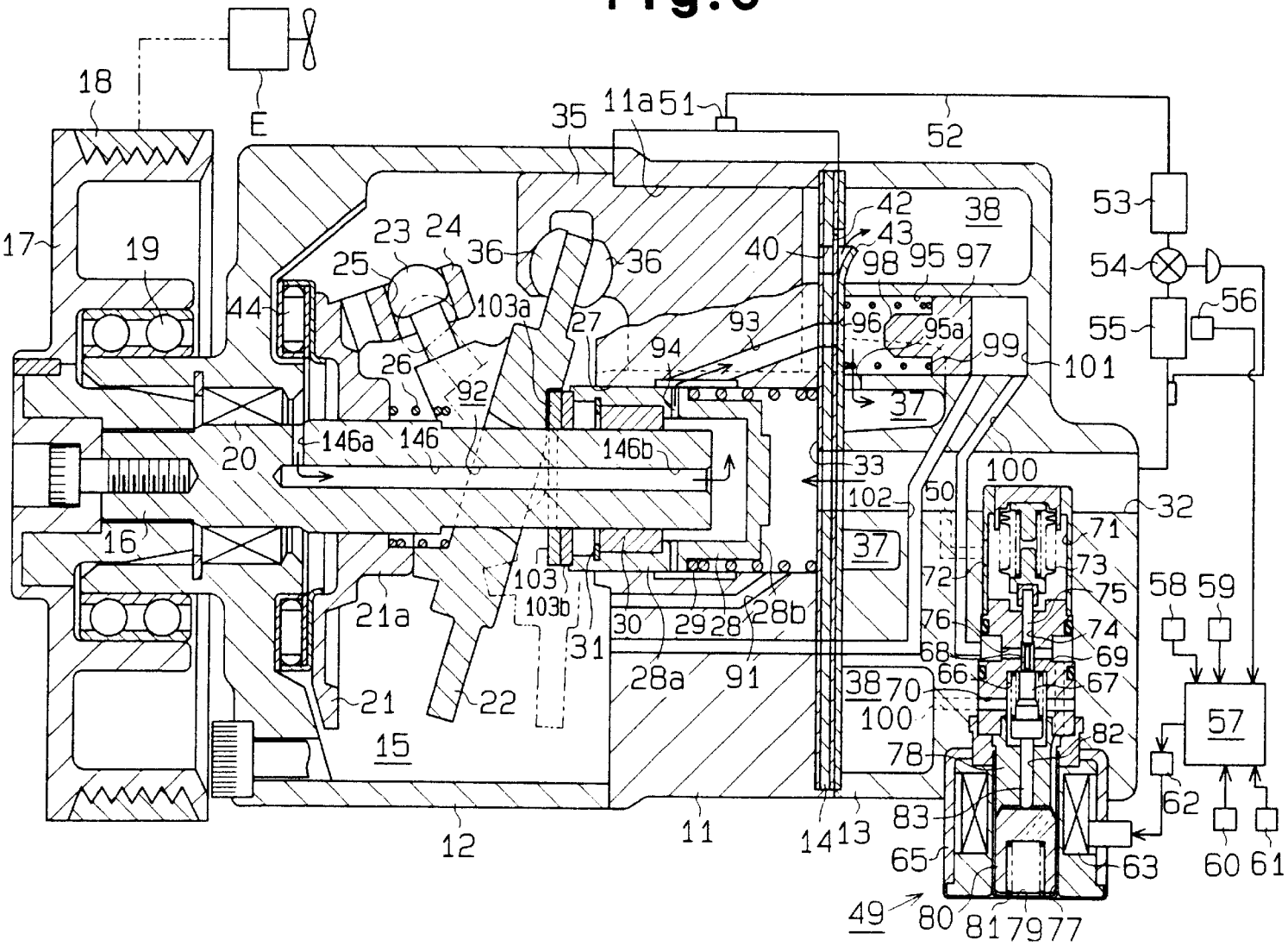
FIG. 5 is a cross-sectional view illustrating a variable displacement compressor according to a third embodiment of the present invention when the inclination of the swash plate is maximum.
Figure 6:
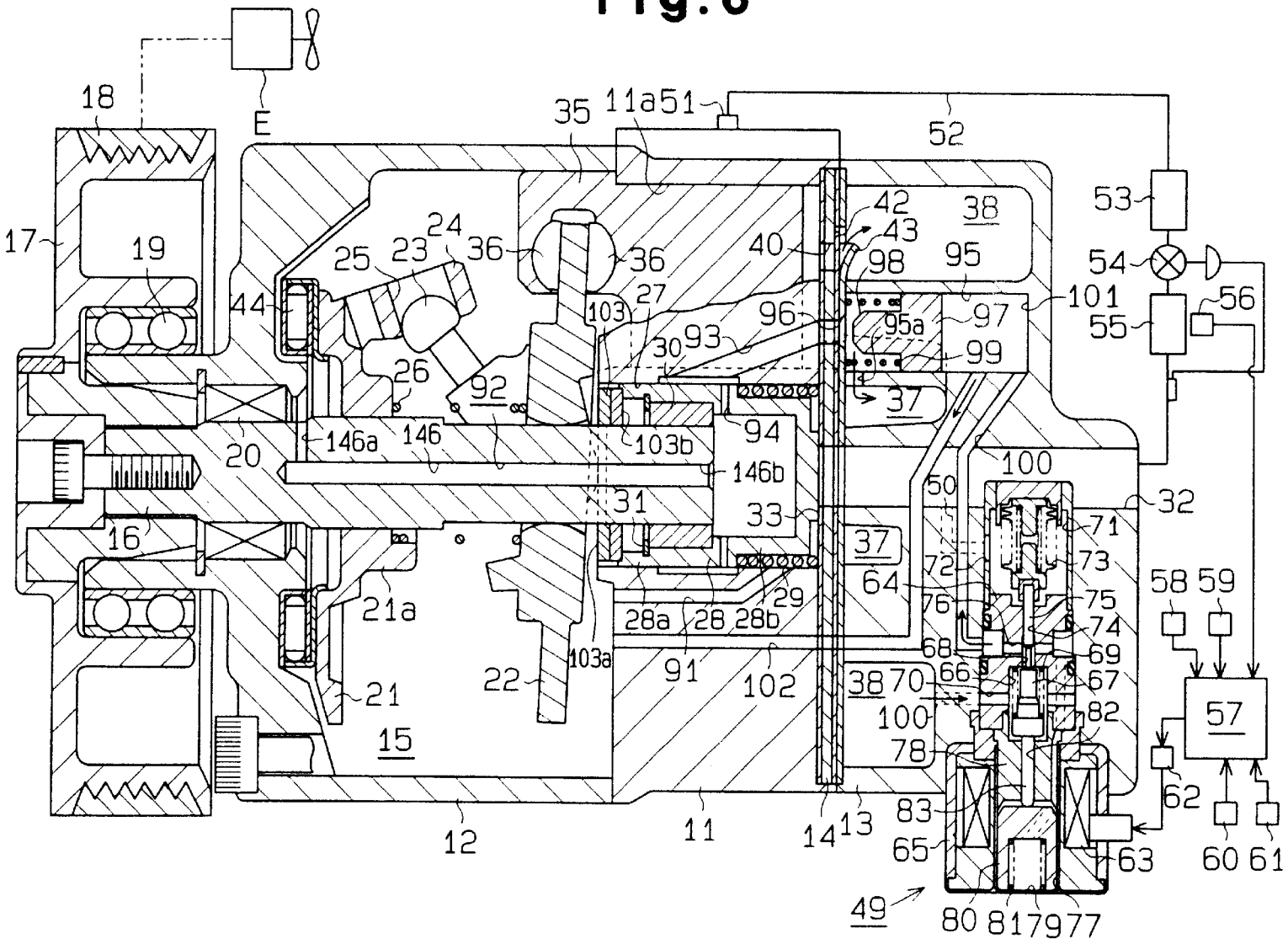
FIG. 6 is a cross-sectional view illustrating the compressor of FIG. 5 when the inclination of the swash plate is minimum.
Figure 7:
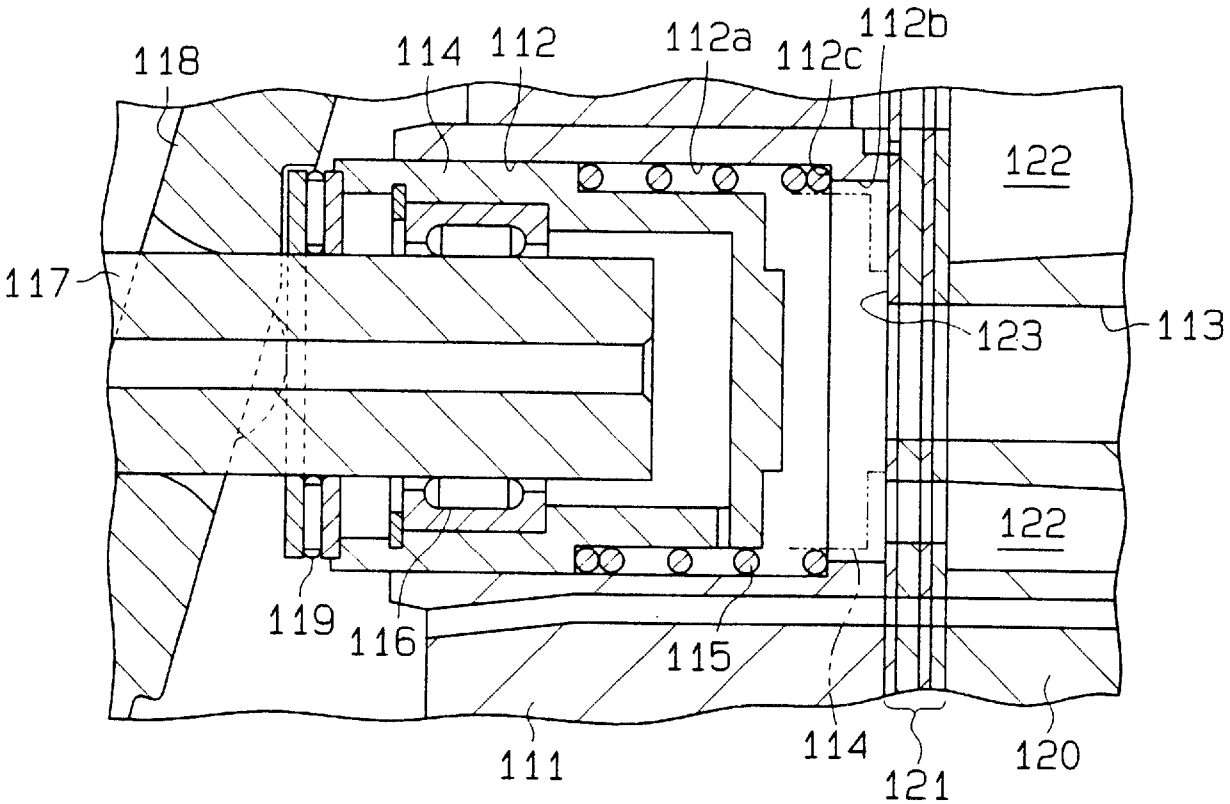
Fig.7 (Prior Art)
FIG. 7 is an enlarged partial cross-sectional view illustrating a prior art variable displacement compressor.

As shown in FIGS. 5 and 6, a second suction passage 91, defined in the cylinder block 11, communicates the shutter chamber 27 with the crank chamber 15. Refrigerant gas supplied to the shutter chamber 27 from the suction passage 32 is drawn into the crank chamber 15 via the second suction passage 91.

An introduction passage 92 communicates the crank chamber 15 with the suction chamber 37. Refrigerant gas in the crank chamber 15 is drawn into the suction chamber 37 via the introduction passage 92. The passage 92 includes a first passage 146, through holes 94, a second passage 93, a valve chamber 95 and a hole 95*a*. The first passage 146 is defined at the center portion of the rotary shaft 16 along the axis of the shaft 16. The first passage 146 has an inlet 146*a*, which opens to the crank chamber 15 in the vicinity of the lip seal 20, and an outlet 146*b*, which opens in the interior of the shutter 28. A plurality of through holes 94 are formed in the peripheral wall near the rear end of the shutter 28. The holes 94 communicate the interior of the shutter 28 with the second passage 93, which is defined in the cylinder block 11 and the valve plate 14. The valve chamber 95 is defined in the rear housing 13 and is communicated with the second passage 93. The hole 105*a* communicates the valve chamber 95 with the suction chamber 37.

A tapered hole 96 is defined in the outlet of the second passage 93. A valve body 97, which functions as a spool valve, is slidably housed in the valve chamber 95. A tapered restricter 98 is defined on an end of the valve body 97 facing the tapered hole 96 of the passage 93. A spring 99 extends between the valve body 97 and the wall of the valve chamber 95 and urges the valve body 97 away from the hole 96.

A pressure control chamber 101 is defined by the rear end face of the valve body 97 and the valve chamber 95. A pressure supply passage 100 is defined in the rear housing 13 and communicates the discharge chamber 38 with the chamber 101. The displacement control valve 49 is accommodated in the rear housing 13 and is located in the passage 100. A pressure release passage 102 is defined in the rear housing 13, the valve plate 14 and the cylinder block 11. The passage 102 communicates the chamber 101 with the crank chamber 15.

In this embodiment, the radial bearing 30, which supports the rear end of the rotary shaft 16, is a journal bearing. Further, a thrust bearing 103, which is a simple sliding bearing, is placed between the swash plate 22 and the shutter 28 instead of the needle thrust bearing 34. The bearing 103 includes a pair of ring-shaped race members 103*a*, 103*b*

The shutter 28 functions as an adjuster for adjusting the minimum inclination position of the swash plate 22. The shutter 28 is made available in different axial lengths. Among the available selection of the shutters 28, one shutter 28 that has an appropriate length is selected. The length of the selected shutter 28 will allow the minimum inclination of the swash plate 22 to match a predetermined minimum inclination position. The compressor is assembled with the selected shutter 28.

Unlike the first and second embodiments, the groove 27*a* is not formed in the shutter chamber 27, and the snap ring 27*b*, which functions as a spring stop, is not used. Instead, the valve plate 14 functions as a spring stop. When the rear housing 13 is attached to the rear end face of the cylinder block 11 with the valve plate 14 in between, the valve plate 14 engages the rear end of the coil spring 29 located in the shutter chamber 27.

The operation of the compressor of FIG. 5 will hereafter be described.

When the compressor is operating, refrigerant gas in the external refrigerant circuit 52 is drawn into the crank chamber 15 via the suction passage 34, the shutter chamber 27 and the second suction passage 91. Refrigerant gas in the crank chamber 15 is then drawn into the suction chamber 37 via the introduction passage 92, which includes the first passage 146, the through hole 94, the second passage 93, the valve chamber 95 and the hole 95*a*. The crank chamber 15 constitutes a part of the passage between the refrigerant circuit 52 and the suction chamber 37.

If the cooling load is great, the current value to the coil 63 in the valve 49 is increased. This increases the magnitude of the attractive force between the core 78 and the plunger 80 thereby increasing the resultant force urging the valve body 67 in a direction closing the valve hole 68. Decreasing the opening between the valve hole 68 and the valve body 67 reduces the amount of gas flow from the discharge chamber 38 to the pressure control chamber 101 via the supply passage 100. Refrigerant gas in the chamber 101, on the other hand, flows into the crank chamber 15 via the passage 102. This lowers the pressure in the chamber 101 thereby moving the valve body 97 rearward, or away from the tapered outlet 96. Accordingly, the restriction of the outlet 96 by the restricter 98 of the valve body 97 is decreased. Decreasing the restriction, or increasing the opening of the outlet 96, increases the amount of gas flow from the crank chamber 15 into the suction chamber 37 via the passage 92. This increases the pressure in the suction chamber 37. Therefore, the difference between the pressure Pc in the crank chamber 15 and the pressure in each cylinder bore 11*a* is small. This increases the inclination of the swash plate 22 as shown in FIG. 22, thereby allowing the compressor to operate at a large displacement.

When the valve hole 68 in the valve 49 is completely closed by the valve body 67, the supply passage 100 is closed. This stops the supply of refrigerant gas from the discharge chamber 38 to the pressure control chamber 101. This further lowers the pressure in the pressure control chamber 101 thereby maximizing the opening between the outlet 96 and the valve body 97. The pressure in the suction chamber 37 is thus further increased. Therefore, the inclination of the swash plate 22 is maximum and the compressor operates at the maximum displacement. When the supply passage 100 is closed by the valve 49, highly pressurized refrigerant gas in the discharge chamber 38 is supplied to the refrigerant circuit 52 but is not supplied to the crank chamber 15 via the passages 100 and 102.

Suppose the cooling load is small, and the current value to the coil 63 in the valve 49 is lowered. This decreases the magnitude of the attractive force between the core 78 and the plunger 80 thereby decreasing the resultant force that urges the valve body 67 in a direction closing the valve hole 68. Increasing the opening between valve hole 68 and the valve body 67 increases the amount of gas flow from the discharge chamber 38 to the pressure control chamber 101 via the supply passage 100. This increases the pressure in the chamber 101 thereby moving the valve body 97 forward, or toward the tapered outlet 96. Accordingly, the restriction between the restricter 98 and the outlet 96 is increased. Increasing the restriction, or decreasing the opening of the outlet 96, decreases the amount of gas flow from the crank chamber 15 into the suction chamber 37 via the passage 92. This lowers the pressure in the suction chamber 37. Therefore, the difference between the pressure Pc in the crank chamber 15 and the pressure in each cylinder bore 11*a* is great. This decreases the inclination of the swash plate 22 as shown in FIG. 6 thereby allowing the compressor to operate at a small displacement.

If the cooling load becomes zero, current supply to the coil 63 of the valve 49 is stopped. This eliminates the magnetic attractive force between the core 78 and the plunger 80. The valve body 67 is moved to a position that maximizes the opening of the valve hole 68. Accordingly, the supply passage 100 is fully opened. This further increases the gas flow from the discharge chamber 38 to the pressure control chamber 101 thereby increasing the pressure in the chamber 101. The pressure moves the valve body 97 forward and maximizes the restriction between the outlet 96 and the valve body 97. The maximum restriction minimizes gas flow from the crank chamber 15 to the suction chamber 37 and lowers the pressure in the suction chamber 37. This minimizes the inclination of the swash plate 22 as shown in FIG. 6 thereby allowing the compressor to operate at the minimum displacement.

As in the first embodiment, the minimum inclination of the swash plate 22 causes the shutter 28 to close the supply passage 32. This stops gas flow from the refrigerant circuit 52 into the suction chamber 37. In this state, refrigerant gas circulates within the compressor traveling through the discharge chamber 38, the supply passage 100, the pressure control chamber 101, the pressure release passage 102, the crank chamber 15, the introduction passage 92, the suction chamber 37 and the cylinder bores 11*a*.

When assembling the compressor, the minimum inclination position of the swash plate 22 is adjusted by using a measuring shutter having a predetermined length. That is, the compressor is temporarily assembled with the measuring shutter. Then, as in the first embodiment, the stroke of the pistons 35, when the swash plate 22 is at the minimum inclination position, is measured. Based on the measured stroke, the shutter 28 that is optimum for the compressor is selected. The measuring shutter is replaced with the selected shutter 28. In this manner, the minimum inclination position of the swash plate 22 is adjusted by the shutter 28.

As in the first embodiment, the replacement of the measuring shutter with the selected shutter 28 is performed from the rear end of the cylinder block 11. Therefore, this embodiment has the same advantages as the first embodiment. Further, unlike the first embodiment, the measuring rear race member is not employed in this embodiment. Instead, the measuring shutter is replaced with the selected shutter 28. Thus, disassembly of the thrust bearing 103 is not necessary. The adjustment of the minimum inclination position of the swash plate 22 is facilitated, accordingly.

The valve plate 14 directly supports the coil spring 29 in the shutter chamber 27. Therefore, this embodiment does not require a separate part for stopping the spring 29. Thus, this construction reduces the number of parts.

The present invention may be alternatively embodied in the following forms:

In the first embodiment, the front race member 34*a* may function as an adjuster for adjusting the minimum inclination position of the swash plate 22. Moreover, both race members 34*a*, 34*b* may function as adjusters.

In the second embodiment, the spacer 85 may be placed between the front race member 34*a* of the thrust bearing 34 and the swash plate 22. Further, a pair of spacers 85 that function as adjusters may be placed between the bearing 34 and the shutter 28 and between the bearing 34 and the swash plate 22, respectively.

In the second embodiment, the minimum inclination position of the swash plate 22 may be adjusted by changing the number of the spacers 85.

In the third embodiment, instead of the shutter 28, at least one of the race members 103*a*, 103*b* of the thrust bearing 103 may function as an adjuster. That is, the minimum inclination position of the swash plate 22 may be adjusted by changing the thickness of at least one of the race members 103*a*, 103*b*. Further, the minimum inclination position of the swash plate 22 may be adjusted by the number of the race members in the thrust bearing 103.

In the first embodiment, the shutter 28 may function as an adjuster as in the third embodiment.

In the first and second embodiments, the valve plate 14 may function as a spring stop instead of the snap ring 27*b*, as in the third embodiment.

In the third embodiment, the annular groove 27*a* may be formed in the shutter chamber 27 and the snap ring 27*b*, which functions as a spring stop, may be fitted in the groove 27*a*, as in the first and second embodiments.

In the above embodiments, the radial bearing 30 may be omitted. In this case, the shutter 28 is made of self-lubricating synthetic resin. The rear end of the rotary shaft 16 is directly supported by and rotates with respect to the shutter 28.

Therefore, the present examples and embodiments are to be considered as illustrative and not restrictive and the invention is not to be limited to the details given herein, but may be modified within the scope and equivalence of the appended claims.

What is claimed is:

1. A compressor including a cylinder block having a cylinder bore, a first housing attached to a first end of the cylinder block to define a crank chamber, a second housing attached to a second end of the cylinder block to define a suction chamber and a discharge chamber, a drive plate located in the crank chamber and mounted on a drive shaft, and a piston operably coupled to the drive plate and located in the cylinder bore, wherein said drive plate converts rotation of the drive shaft to reciprocating movement of the piston in the cylinder bore, said piston compressing gas supplied to the cylinder bore from a separate external circuit by way of a suction chamber and discharging the compressed gas to the external circuit by way of a discharge chamber, wherein the drive plate is tiltable between a maximum inclination position and a minimum inclination position according to a difference between the pressure in the crank chamber and the pressure in the cylinder bore, said piston moving by a stroke based on the inclination of the drive plate to control the displacement of the compressor, said compressor comprising:

said cylinder block having a shutter chamber extending along an axis of the drive shaft and opening to said first end and said second end;

a shutter member accommodated in the shutter chamber and movable along the axis of the drive shaft, wherein said shutter member is movable between a first position and a second position in response to the inclination of the drive plate, said shutter member connecting the external circuit with the suction chamber in the first position and disconnecting the external circuit from the suction chamber in the second position, wherein said drive plate is held at the minimum inclination position when the shutter member is positioned in the second position; and said shutter chamber having a diameter that allows said shutter member to be removably inserted into the shutter chamber from the second end of the cylinder block.

2. The compressor according to claim 1, wherein the diameter of said shutter chamber is constant in an axial direction with respect to the shutter chamber.

3. The compressor according to claim 1 further comprising a spring located in the shutter chamber to bias the shutter member toward the drive plate.

4. The compressor according to claim 3 further comprising:

said shutter chamber having an inner surface that has an engaging groove; and a receiving member detachably fitted in the engaging groove to receive the spring.

5. The compressor according to claim 3 further comprising an adjuster located between the drive plate and the spring to adjust the minimum inclination position of the drive plate.

6. The compressor according to claim 5 further comprising a thrust bearing supported on the drive shaft between the drive plate and the shutter member and movable along the axis of the drive shaft.

7. The compressor according to claim 6, wherein said thrust bearing has at least one race member that forms said adjuster, wherein said race member has a thickness in the axial direction with respect to the drive shaft, and wherein the minimum inclination position of the drive plate is adjusted by the thickness of the race member.

8. The compressor according to claim 6, wherein said adjuster includes a spacer located adjacent to the thrust bearing, wherein said spacer has a thickness in the axial direction with respect to the drive shaft, and wherein the minimum inclination position of the drive plate is adjusted by the thickness of the spacer.

9. The compressor according to claim 5, wherein said adjuster includes said shutter member, wherein said shutter member has a length in the axial direction with respect to the drive shaft, and wherein the minimum inclination position of the drive plate is adjusted by the length of the shutter member.

10. The compressor according to claim 6, wherein said thrust bearing includes a rolling bearing.

11. The compressor according to claim 1 further comprising:

a positioning surface located at the second end of the cylinder block and facing the shutter member; and said shutter member having an end surface that abuts against the positioning surface when the shutter member is positioned in the second position.

12. The compressor according to claim 11 further comprising:

said second housing having said suction chamber and said discharge chamber; and a valve plate located between the second end of the cylinder block and the second housing to separate the cylinder bore from the suction chamber and the discharge chamber, said valve plate having said positioning surface.

13. The compressor according to claim 12 further comprising:

said shutter chamber communicating with the suction chamber;

a suction passage defined in the second housing to connect the external circuit with the shutter chamber, wherein the gas is supplied to the suction chamber from the external circuit through the suction passage and the shutter chamber; and said positioning surface being disposed between the shutter chamber and the suction passage, wherein said shutter member disconnects the suction passage from the shutter chamber by the end surface that abuts against the positioning surface.

14. The compressor according to claim 13 further comprising:

said shutter member having a hollow cylindrical shape; and a radial bearing disposed within the shutter member to rotatably support the drive shaft.

15. The compressor according to claim 1 further comprising means for adjusting the pressure in one of the crank chamber and the suction chamber to vary the difference between the pressure in the crank chamber and the pressure in the cylinder bore, wherein said adjusting means includes a gas passage for passing the gas used for adjusting the pressure and a control valve for adjusting the amount of the gas flowing in the gas passage.

16. The compressor according to claim 15, wherein said gas passage includes a supply passage for connecting the discharge chamber with the crank chamber, wherein said control valve is placed midway in the supply passage for adjusting the amount of the gas introduced into the crank chamber from the discharge chamber through the supply passage to control the pressure in the crank chamber.

17. The compressor according to claim 15, wherein said adjusting means includes:

a suction passage for connecting the external circuit with the crank chamber;

an introducing passage for connecting the crank chamber with the suction chamber, wherein the gas is supplied to the suction chamber from the external circuit through the suction passage, the crank chamber and the introducing passage;

an adjusting valve placed midway in the introducing passage for adjusting the amount of the gas supplied to the suction chamber from the external circuit to control the pressure in the suction chamber;

said gas passage including a pressure applying passage for introducing the gas to the adjusting valve from the discharge chamber to apply the pressure in the discharge chamber to the adjusting valve; and said control valve being placed midway in the pressure applying passage for adjusting the amount of the gas introduced to the adjusting valve from the discharge chamber through the pressure applying passage to control the pressure applied to the adjusting valve, wherein said adjusting valve controls the opening size of the introducing passage in accordance with the pressure applied to the adjusting valve.

18. The compressor according to claim 5 further comprising an external driving source coupled directly to the drive shaft to rotate the drive shaft.

19. A compressor including a cylinder block having a cylinder bore, a first housing attached to a first end of the cylinder block to define a crank chamber, a second housing attached to a second end of the cylinder block via a valve plate to define a suction chamber and a discharge chamber, a drive plate located in the crank chamber and mounted on a drive shaft, and a piston operably coupled to the drive plate and located in the cylinder bore, wherein said drive plate converts rotation of the drive shaft to reciprocating movement of the piston in the cylinder bore, said piston compressing gas supplied to the cylinder bore from a separate external circuit by way of a suction chamber and discharging the compressed gas to the external circuit by way of a discharge chamber, wherein the drive plate is tiltable between a maximum inclination position and a minimum inclination position according to a difference between the pressure in the crank chamber and the pressure in the cylinder bore, said piston moving by a stroke based on the inclination of the drive plate to control the displacement of the compressor, said compressor comprising:

said cylinder block having a shutter chamber extending along an axis of the drive shaft and opening to said first end and said second end;

a shutter member accommodated in the shutter chamber and movable along the axis of the drive shaft, wherein said shutter member is movable between a first position and a second position in response to the inclination of the drive plate, said shutter member connecting the external circuit with the suction chamber in the first position and disconnecting the external circuit from the suction chamber in the second position;

said valve plate having a positioning surface facing the shutter member;

said shutter member having an end surface that abuts against the positioning surface when the shutter member is positioned in the second position, wherein said drive plate is held at the minimum inclination position when the end surface abuts against the positioning surface;

said shutter chamber having a diameter that is constant in an axial direction with respect to the shutter chamber, whereby said shutter member is removably inserted into the shutter chamber from the second end of the cylinder block;

a spring located in the shutter chamber to bias the shutter member toward the drive plate; and an adjuster located between the drive plate and the spring to adjust the minimum inclination position of the drive plate.

20. The compressor according to claim 19 further comprising:

said shutter chamber having an inner surface that has an engaging groove; and a receiving member detachably fitted in the engaging groove to receive the spring.

21. The compressor according to claim 19 further comprising a thrust bearing supported on the drive shaft between the drive plate and the shutter member and movable along the axis of the drive shaft, wherein said thrust bearing has at least one race member that forms said adjuster, wherein said race member has a thickness in the axial direction with respect to the drive shaft, and wherein the minimum inclination position of the drive plate is adjusted by the thickness of the race member.

22. The compressor according to claim 19 further comprising a thrust bearing supported on the drive shaft between the drive plate and the shutter member and movable along the axis of the drive shaft, wherein said adjuster includes a spacer located adjacent to the thrust baring, wherein said spacer has a thickness in the axial direction with respect to the drive shaft, and wherein the minimum inclination position of the drive plate is adjusted by the thickness of the spacer.

23. The compressor according to claim 19, wherein said adjuster includes said shutter member, wherein said shutter member has a length in the axial direction with respect to the drive shaft, and wherein the minimum inclination position of the drive plate is adjusted by the length of the shutter member.

24. The compressor according to claim 19 further comprising means for adjusting the pressure in one of the crank chamber and the suction chamber to vary the difference between the pressure in the crank chamber and the pressure in the cylinder bore, wherein said adjusting means includes a gas passage for passing the gas used for adjusting the pressure and a control valve for adjusting the amount of the gas flowing in the gas passage.

25. A method for assembling a variable displacement compressor, wherein said compressor includes a cylinder block having a cylinder bore, a first housing attached to a first end of the cylinder block, a second housing attached to a second end of the cylinder block, a crank chamber defined between the cylinder block and the first housing, a drive plate located in the crank chamber and mounted on a drive shaft, and a piston operably coupled to the drive plate and located in the cylinder bore, wherein said drive plate converts rotation of the drive shaft to reciprocating movement of the piston in the cylinder bore, said piston compressing gas supplied to the cylinder bore from a separate external circuit by way of a suction chamber and discharging the compressed gas to the external circuit by way of a discharge chamber, wherein the drive plate is tiltable between a maximum inclination position and a minimum inclination position according to a difference between the pressure in the crank chamber and the pressure in the cylinder bore, said piston moving by a stroke based on the inclination of the drive plate to control the displacement of the compressor, wherein said compressor further includes a shutter chamber extending through the cylinder bore from said first end to said second end, a shutter member accommodated in the shutter chamber and movable along the axis of the drive shaft, a thrust bearing supported on the drive shaft between the drive plate and the shutter member, and a spring for biasing the shutter member toward the drive plate, wherein said shutter member is movable between a first position and a second position in response to the inclination of the drive plate, said shutter member connecting the external circuit with the suction chamber in the first position and disconnecting the external circuit from the suction chamber in the second position, wherein said drive plate is held at the minimum inclination position when the shutter member is positioned in the second position, said method comprising the steps of:

attaching the first housing, the drive shaft, the drive plate and the piston to the cylinder block from said first end;

inserting the thrust bearing, the shutter member and the spring into the shutter chamber from said second end before the second housing is attached to the second end; and attaching a receiving member to the cylinder block from the second end to receive the spring.

* * * * *